US005988013A

United States Patent [19]

Carr, Jr. et al.

[11] Patent Number: 5,988,013

[45] Date of Patent: Nov. 23, 1999

[54] MOUNTING ARRANGEMENT FOR A CONTROL LEVER

[75] Inventors: Charles W. Carr, Jr., Naperville; Max D. Fryrear, Oswego; Derek D. Greving, Morton; Mary A. Kuhn, Brookfield, all of Ill.

[73] Assignee: Caterpillar Inc., Peoria, Ill.

[21] Appl. No.: 08/982,094

[22] Filed: Dec. 1, 1997

[51] Int. Cl.[6] ..... G05G 5/05

[52] U.S. Cl. ..... 74/532; 74/527

[58] Field of Search ..... 74/473.25, 532, 74/533, 535, 527

[56] References Cited

U.S. PATENT DOCUMENTS

| | | | |
|---|---|---|---|
| 1,914,506 | 6/1933 | House | 74/533 |
| 2,922,669 | 1/1960 | Hansen | 74/527 |
| 3,534,629 | 10/1970 | Schwerdhofer | 74/535 |
| 4,840,083 | 6/1989 | Hagan et al. | 74/527 |
| 5,537,892 | 7/1996 | Wiechman | 74/527 |

FOREIGN PATENT DOCUMENTS

| | | | |
|---|---|---|---|
| 002058511 | 6/1992 | Canada | 74/527 |

*Primary Examiner*—Thomas R. Hannon
*Assistant Examiner*—Chong H. Kim
*Attorney, Agent, or Firm*—William C. Perry; Byron G. Buck, II

[57] ABSTRACT

In the operation of construction machines having multiple functions it has been a problem to provide a mounting arrangement for the levers that incorporates low lever effort operational detents without experiencing undue wear within the components. The present invention provides a mounting arrangement for a control lever that has a plurality of upraised ribs defined thereon in a preselected array. A plurality of grooves are positioned on an adjacent bearing member that are positioned to engage the upraised ribs in a first condition of the control lever. The control lever may be rotated out of engagement with the ribs to operate in a second condition while at the same time being engageable with a plurality of operational detents to provided feedback to an operator as to impending operational conditions.

18 Claims, 3 Drawing Sheets

MOUNTING ARRANGEMENT FOR A CONTROL LEVER

TECHNICAL FIELD

This invention relates to a control lever and more particularly to a mounting arrangement therefore that incorporates a centering device and operational indicators.

BACKGROUND ART

In the operation of modern day construction machines, it is becoming increasingly common to incorporate electronic controls into the operation of the machine. One of the advantages gained by utilizing electronic controls is that the control levers may be downsized and the operational effort required to manipulate them is greatly reduced. In addition, it has been known to incorporate some operational indicators utilized in many implement functions into the design of the control lever mounting.

One such example is disclosed in U.S. Pat. No. 5,537,892, issued on Jul. 23, 1996 to Dean A. Weichman. In this design, a control lever is positioned between two non-metallic bearing members that are biased for engagement with the control levers. The bearing members have a plurality of grooves and recesses positioned on either side of a central portion that engages the shank of the control lever as it is moved throughout its ranges of movement. While this design has been known to work quite well in most instances, there are applications wherein the movement of the control lever with respect to the bearing member has caused wear of the bearing member to a point wherein the operational indicators, i.e., ramps that have been formed in the bearing members that indicate various phases of operation, have been diminished.

The present invention is directed to overcoming one or more of the problems as set forth above.

DISCLOSURE OF THE INVENTION

In one aspect of the present invention a control lever arrangement is provided in which a control lever is mounted within a housing. The control lever has first and second upraised ribs formed on a portion thereof. The upraised ribs are positioned at a preselected angle with respect to one another. The control lever is rotatably mounted within the housing for movement between first and second positions. A bearing member is included that has first and second angled grooves formed therein. The grooves are positioned at a preselected angle with respect to one another in a manner substantially equal to the angle of the upraised ribs. The bearing member is positioned within the housing for biased engagement with the control lever to position the ribs of the control lever within the grooves of the bearing member when the control lever is in the first position. The upraised ribs are removed from engagement with the grooves when the control lever is in the second position.

In another aspect of the present invention, a control lever arrangement is provided that mounts a control lever in a housing. The control lever has a generally planar mounting portion defined thereon. A pair of pivot shafts are defined on the mounting portion to extend axially therefrom. A plurality of upraised ribs are defined on the mounting portion in a preselected angular array and are positioned to extend radially from one of the pivot shafts. The control lever is rotatably mounted within the housing between first and second operating positions. A pair of bearing members is included that have a bore extending therethrough. A plurality of grooves is defined in a first surface thereof. The grooves are positioned to extend radially from the bore in a preselected angular array to define a substantially planar land portion between each of said grooves. The preselected angular array of said grooves is substantially equal to that of the grooves is substantially equal to that of the upraised ribs. The bearing members are positioned on opposite sides of the mounting portion with the respective pivot shafts received in the respective bores of the bearing members and the grooves of one of the bearing members positioned for nesting engagement with the upraised ribs of the mounting portion when the control lever is in its first position. A biasing means is provided for biasing the bearing members into engagement with the control lever.

With a control lever arrangement as set forth above, a control lever mounting is provided that employs the use of non-metallic bearing members that engage a control lever of similar construction. The bearing members define a plurality of grooves on a face thereof that is biased into engagement with the ribs on the control lever. This configuration provides a detented neutral position for the control lever that provides a very positive restraint while at the same time permits movement of the lever with low effort. Due to the configuration of the grooves and the ribs, the detented neutral position and operational indicators incorporated into the control lever arrangement are not subject to reduced effectiveness due to wear while maintaining the advantages of electronic controls.

BEST MODE FOR CARRYING OUT THE INVENTION

Figure 1:
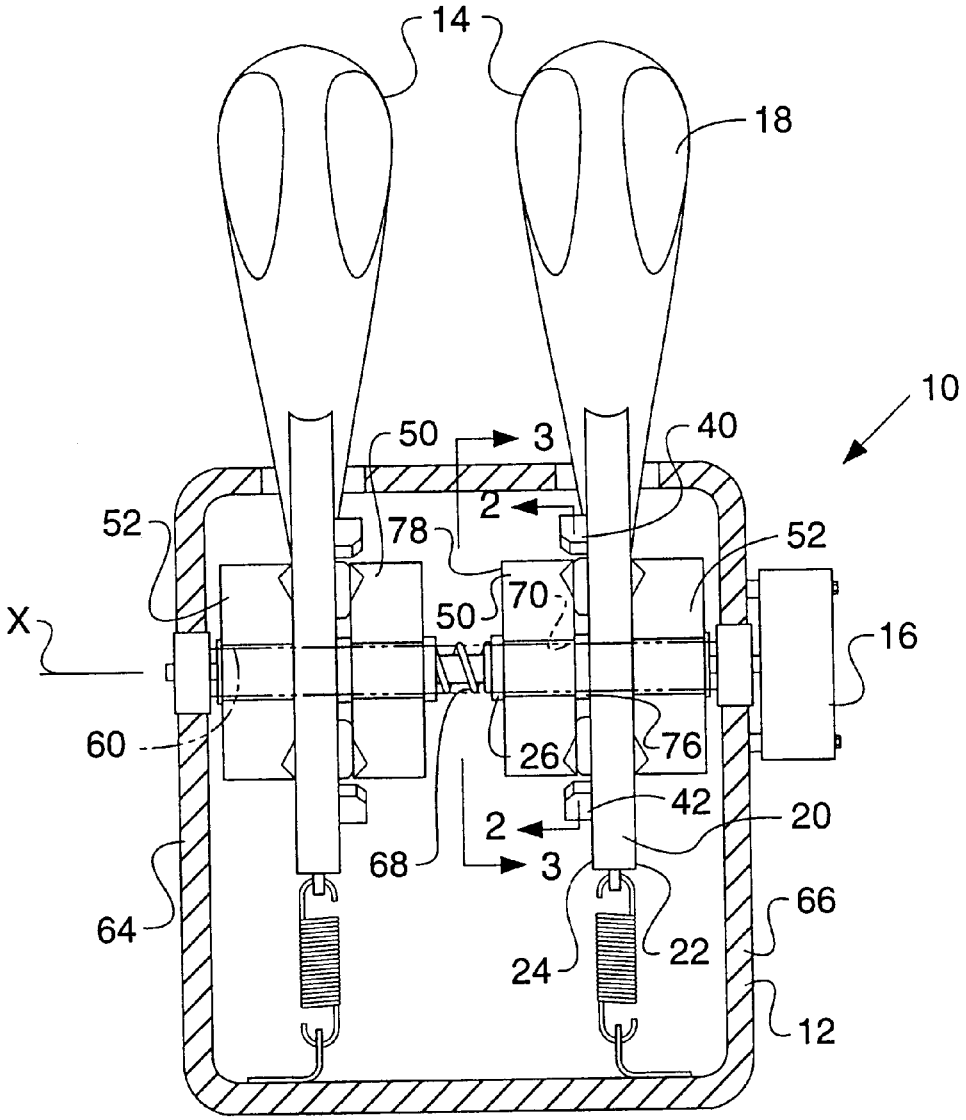
FIG. 1 is diagrammatic elevational view of a control lever arrangement that embodies the principles of the present invention.

Referring to the drawings, a mounting arrangement 10 is shown that includes a housing 12 that rotatably mounts a plurality of control levers 14. The housing is typically positioned in the cab (not shown) of a machine for the manipulation of any number of work implements or machine controls. The housing is secured to the cab in an area that is within close proximity to an area normally occupied by a machine operator. An electronic control module 16 is mounted externally of the housing 12 and engages the each of the control levers for operation of the desired function in a manner to be described in greater detail hereinafter.

One of the control levers 14 is shown to be mounted within the housing 12 for rotation with respect thereto about an axis X. The control lever defines a grasping portion 18 that extends upwardly from the housing 12 and a mounting portion 20 that is generally centrally positioned on the control lever 14 and is located within the housing. The mounting portion 20 is defined by a plate-type configuration and defines first and second side portions 22 and 24 on opposite sides thereof. A pair of pivot shafts 26 and 28 are defined on the mounting portion 20 and extend axially from the respective sides 22 and 24 about a common axis 30, which is coincident with axis X in the installed position. A plurality of upraised ribs 32, 34, 36 and 38 are defined on the first side 22 and extend radially outwardly from the axis 30 in intersecting relationship with the pivot shaft 26. In the illustrated embodiment, the upraised ribs are shown to be positioned in an "X" configuration such that the ribs are separated from one another at an angle of approximately 90 degrees.

A pair of abutment members 40 and 42 are positioned on the first side 22 of the control lever, abutment member 40 being positioned in spaced relationship above the axis 30 while abutment member 42 is spaced substantially an equal distance below axis 30. Each abutment member extends in an axial direction from the first side 22 and defines first and second angled surfaces 46 and 48 (FIG. 2) that face toward the axis 30.

A pair of bearing members 50 and 52 is positioned on opposite sides of the control lever 14, as can be seen in FIG. 1, to mount the control lever to the housing 12. Each bearing member is substantially identical to one another and for that reason, only bearing member 50 will be described in detail, it being understood that the same reference numerals with be equally applicable to all bearing members. Each bearing member defines a pair of mounting grooves 54, positioned in opposing end portions 56 and 58 of the bearing member 50. The mounting grooves are adapted to receive at least a portion of a pair of transversely extending rods 60 that extend between a pair of opposing end plates 64 and 66 defined by the housing 12. Being so mounted, the bearings are allowed to reciprocate on the rods toward and away from the control lever. A biasing means 68 in the form of a spring is provided between the adjacent bearing members 50 in the housing 12 to urge the bearing members into contact with the control lever 14, as is best shown in FIG. 1.

Figure 2:
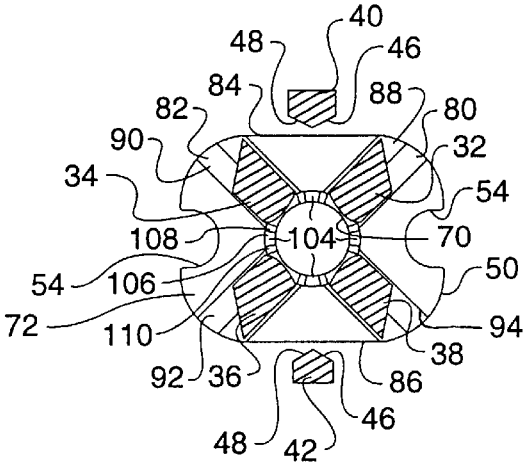
FIG. 2 is a diagrammatic section view of the control lever arrangement shown in FIG. 1, taken along lines 2—2 of FIG. 1.
Figure 5:
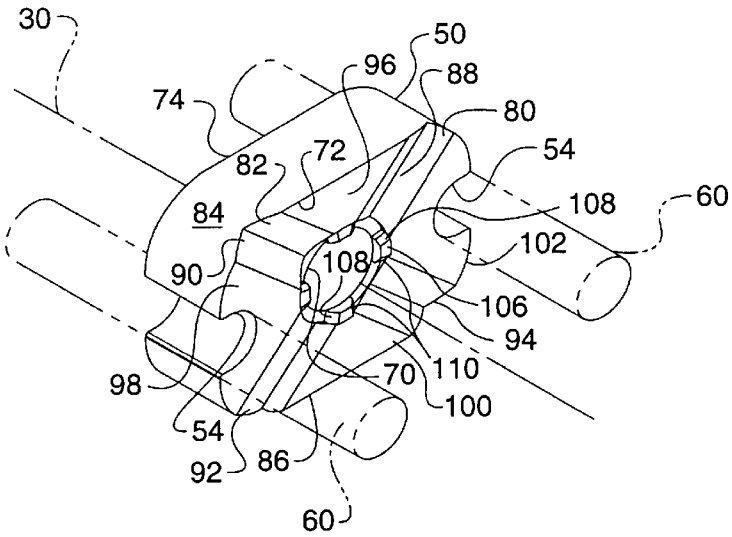
FIG. 5 is a diagrammatic isometric view of one of the bearing members of the present invention.

Turning now to FIGS. 2 and 5, it can be seen that a bore 70 is defined to extend through a central portion of the bearing member 50. The bore 70 is of sufficient size to receive one of the pivot shafts 26 and 28 that extend from the control lever 14. Each bearing member has a pair of surfaces 72 and 74 defined on respective opposite sides 76 and 78 thereof. The side 76 of each bearing arrangement has a pair of grooves 80 and 82 defined therein that extend from an upper surface 84 of the bearing member 50 to a lower surface 86 thereof. The grooves 80 and 82 are angled with respect to one another and are positioned in a manner to define an "X" shaped configuration that passes through the center of the bore 70. The two grooves are thus divided by the bore into four groove segments 88, 90, 92 and 94 that are positioned in a preselected array that matches the configuration defined by the upraised ribs 32, 34, 36 and 38 formed on the mounting portion 20 of the control lever 14. The surface between the groove segments, is defined by a plurality of substantially planar lands 96, 98, 100 and 102. Each of the grooves extends axially inwardly from the surface 72 and are substantially "V" shaped in configuration having sloped sides of approximately 30 degrees. While this illustrated design is believed to be an optimum configuration, it is to be understood that the angle between each the grooves as well as their specific shape may vary without departing from the principles of the present invention.

A plurality of wear projections 104 are disposed radially about the bore 70 in closely adjacent proximity thereto. Each wear projection is located such that it is substantially centered with respect to each land portion 96, 98, 100 and 102. As is best shown in FIG. 2, each wear projection defines a centrally disposed point 106 and a pair of angled side portions 108 and 110 that extends from opposite sides of the point toward the surface 72 of the bearing member 50. When in the installed position, the points 106 of the wear projections are positioned between the upraised ribs 32, 34, 36 and 38 of the control lever 14, generally in close proximity to the pivot shaft 26 where the individual ribs converge.

Both the control lever 14 and the bearing members 50 and 52 are made of a non-metallic material to provide the desired performance and wear characteristics and to reduce the overall weight of the components. The material utilized in the subject invention is a long glass reinforced, easy molding nylon that is lubricated with Polytetrafluoroethylene (PTFE). While this material is commercially available under several trade names, the one utilized in the subject invention is known as Verton RFL-EM-HS. It is to be understood that other materials may also be utilized that may work as well in similar applications.

While the illustrated embodiment discloses a control lever having ribs defined on only one surface engaged with a grooved surface of only one bearing member, it is to be understood that both surfaces of the control lever could define ribs and both bearing members could be positioned for engagement with the ribs without departing from the principles of the invention. Likewise, the number of the grooves and ribs may vary as well as the array in which they are positioned. Still further, it is envisioned that the ribs and grooves may be interchanged with respect to the respective components in which they are defined.

INDUSTRIAL APPLICABILITY

Operation of the control lever 14 typically begins from a neutral position which is shown in FIG. 1. It is moveable along a plane that extends between the bearing members 50 and 52 in either direction from the neutral position. When in this first position, the upraised ribs 32, 34, 36 and 38 of the control lever 14 are nested within the respective grooves segments 88, 90, 92 and 94 as is shown in FIG. 2. The groove segments are urged into engagement with the ribs due to the bias provided by the spring 68.

When the control lever 14 is to be manipulated, an operator may engage the grasping portion 18 and move it in the desired direction, rotating it about the axis X (FIG. 1). Upon initiation of control lever movement, the point 106 of the wear projection 104 and the angled surface 108 and 110 adjacent the respective ribs, work in conjunction with one another to move the bearing member 50, in a direction against the bias of the spring 68, out of engagement with the respect grooves. When this occurs, the point 106 of the respective wear projection 104 will engage the land portions 96, 98, 100 and 102 on the bearing member 50 between the grooves and the control lever is permitted to move in a second position with respect to the bearing member. The effort required to move the control lever and operate in this second functional condition is very low. Should it be desirable to continue to move the control lever in a direction away from the neutral position, for increased power for an implement for example, the control lever 14 will be allowed to move until the abutment members 42 and 44 engage the respective upper and lower surfaces 84 and 86 of the bearing member 50. This creates an operational detent, in the travel of the control lever, slightly increasing the effort required to move the lever. This serves to inform an operator of an impending third condition of control lever operation should the movement of the control lever continue in that direction.

Figure 3:
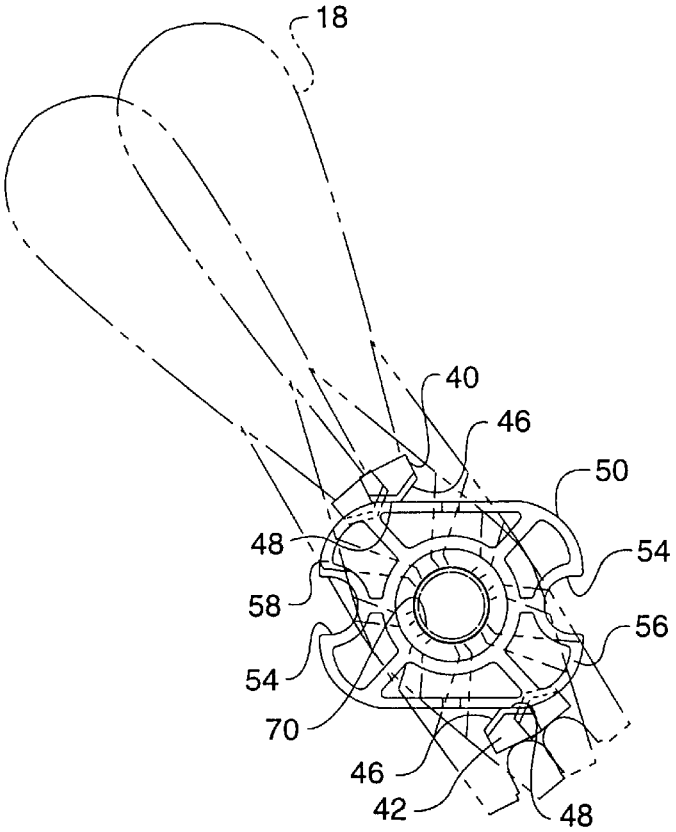
FIG. 3 is a diagrammatic section view of the control lever arrangement taken along lines 3—3 of FIG. 1.
Figure 4:
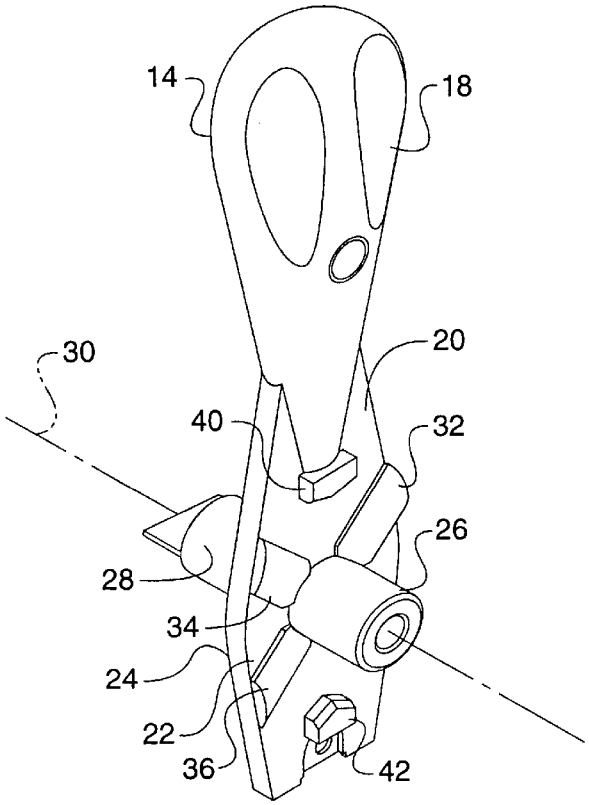
FIG. 4 is a diagrammatic isometric view of the control lever.

This position is best shown in FIG. 3. If continued movement is desired, the appropriate angled surface 46 or 48 defined by the respective abutment members 42 and 48 will engage the bearing member and urge it away from the control lever. This permits the abutment members to engage the surface of the side portion 22 of the control lever and operate in a third position with respect to the bearing member. This position is shown in phantom lines in FIG. 3. Movement of the control lever in the opposite direction will result in the same interaction between the control lever and the bearing members.

This arrangement permits the control lever to be mounted in a manner that requires relatively few components that are light weight and very cost effective to manufacture. In addition, the operational detents are integrated into the construction of the control lever and bearing members in a manner wherein wear, that inevitably occurs during the operation of the control lever assembly, will not adversely affect the performance of the arrangement during operation.

Other aspects, objects and advantages of this invention can be obtained from a study of the drawings, the disclosure and the appended claims.

We claim:

1. A control lever arrangement, comprising:

a housing;

a control lever having a plurality of upraised ribs formed on a portion thereof, said upraised ribs being positioned at a preselected angle with respect to one another, said control lever being rotatably mounted within the housing for movement between first and second positions;

a bearing member having a plurality of angled grooves formed therein, said grooves being positioned at a preselected angle with respect to one another in a manner substantially equal to the angle defined by the upraised ribs, said bearing member being positioned within the housing for biased engagement with the control lever to position the ribs of the control lever within the grooves of the bearing member when the control lever is in the first position and wherein the upraised ribs are removed from engagement with the grooves when the control lever is in the second position; and a wear projection having a pair of angled side portions positioned between the first and second grooves, said angled side portions being adapted for engagement with the upraised ribs to initiate movement of the bearing member against the biasing force whereupon movement of the control lever toward its second position is initiated.

2. The control lever arrangement as set forth in claim 1, wherein the control lever has a substantially planar mounting portion defined along a central portion thereof, said mounting portion having first and second opposing side portions formed thereon and a pair of generally cylindrical pivot shafts extending from each of the first and second side portions.

3. The control lever arrangement as set forth in claim 2 wherein the upraised ribs are defined on at least one of the first and second side portions of the mounting portion and intersect one another at a point about which the pivot shafts are substantially centered and extend radially outwardly from at least one of said pivot shafts.

4. The control lever arrangement as set forth in claim 3 wherein the upraised ribs define first, second, third and fourth upraised portions and extend in a radially outward direction from the pivot shaft to define a generally "X" shaped configuration about said one of the pivot shafts.

5. The control lever arrangement as set forth in claim 1 wherein the bearing member defines a bore that extends therethrough and is substantially centered about the intersection of the angled grooves.

6. The control lever arrangement as set forth in claim 5 wherein the first and second grooves are positioned in a generally "X" shaped configuration, defining first, second, third and fourth segments that extend radially outwardly from the bore in the bearing member.

7. The control lever arrangement as set forth in claim 1 wherein a generally planar land portion is positioned between the angled grooves, said upraised ribs being adapted for engagement with the land portion when the control lever is operating in its second position.

8. The control lever arrangement as set forth in claim 2 wherein an abutment member is positioned on the planar mounting portion at a location that is radially spaced from the bearing member, said control lever being rotatable relative to the bearing member to bring the abutment member into contact with the bearing member to indicate an impending operation of the control lever in a third position.

9. The control lever arrangement as set forth in claim 8 wherein the abutment member defines a pair of angled surfaces that are engageable with the bearing member to move the bearing member against the biasing force to allow the abutment member to engage a planar land defined by the bearing member and operate in a third position.

10. The control lever arrangement as set forth in claim 2 wherein a grasping portion extends upwardly from the planar mounting portion and is adapted for engagement by a machine operator to move the control lever between its operating positions.

11. A control lever arrangement, comprising:

a housing;

a control lever having a generally planar mounting portion defined thereon, a pair of pivot shafts defined on the mounting portion to extend axially therefrom and a plurality of upraised ribs defined on the mounting portion in a preselected angular array and being positioned to extend radially from one of said pivot shafts, said control lever being rotatably mounted within the housing between first and second operating positions wherein an abutment member is positioned between the mounting and grasping portions of the control lever at a location that is spaced from the bearing members, said abutment member being moveable relative to the bearing members with the rotation of the control lever to a position that is engageable with at least one of the bearing members to indicate the movement of the control lever into a third operating position;

a pair of bearing members having a bore extending therethrough and a plurality of grooves defined in a first surface thereof, said grooves being positioned to extend radially from the bore in a preselected angular array to define a substantially planar land portion between each of said grooves, said preselected angular array of said grooves being substantially equal to that of said upraised ribs, said bearing members being positioned on opposite sides of the mounting portion with the respective pivot shafts received in the respective bores of the bearing members and the grooves of at least one of said bearing members positioned for nesting engagement with the upraised ribs of the mounting portion when the control lever is in its first position; and means for biasing the bearing members into engagement with the control lever.

12. The control lever as set forth in claim 11 wherein a grasping portion is defined by the control lever and extends radially outwardly from the mounting portion.

13. The control lever as set forth in claim 12 wherein the abutment member has a pair of angled side surfaces that are engageable with the bearing member to move the bearing member against the biasing means to permit the abutment member to contact one of the lands defined by the bearing member when the control lever is operating in a third position.

14. The control lever as set forth in claim 11 wherein the bearing member further defines a plurality of wear projections positioned about the bore and being centered between the grooves defined therein, said wear projections having a pair of angled side surfaces extending in opposite directions from a centrally disposed tip and being adapted for engagement with one of the respective upraised ribs to initiate movement of the bearing member against the biasing means upon movement of the control lever from its first to its second operating condition.

15. The control lever as set forth in claim 12 wherein the biasing means includes a spring member positioned between the housing and at least one of the bearing members to urge the bearing member into engagement with the control lever and to maintain the control lever in its first operating position in absence of an application of a preselected force to the grasping portion of the control lever in either of a first or second direction.

16. The control lever as set forth in claim 11 wherein the bearing members further define a pair of mounting grooves in opposing sides thereof, said grooves being engageable with a pair of mounting shafts defined by the housing for reciprocating movement with respect thereto.

17. The control lever as set forth in claim 11 wherein the bearing members and the control lever are comprised of a non-metallic material.

18. The control lever as set forth in claim 11 wherein an electronic control means is mounted to the housing for engagement with one of the pivot shafts to sense the position of the pivot shaft and thereby control one of a plurality of operations on a construction machine.

* * * * *